US006010311A

United States Patent [19]

Thoma et al.

[11] Patent Number: 6,010,311

[45] Date of Patent: Jan. 4, 2000

[54] HYDRAULIC RADIAL PISTON MACHINES

[75] Inventors: Christian Helmut Thoma; George Duncan McRae Arnold; Arthur Atholl Blair, all of Jersey, United Kingdom

[73] Assignee: Unipat AG, Glarus, Switzerland

[21] Appl. No.: 08/750,293

[22] PCT Filed: Jun. 6, 1995

[86] PCT No.: PCT/GB95/01302

§ 371 Date: Dec. 5, 1996

§ 102(e) Date: Dec. 5, 1996

[87] PCT Pub. No.: WO95/33925

PCT Pub. Date: Dec. 14, 1995

[30] Foreign Application Priority Data

Jun. 7, 1994 [GB] United Kingdom ..... 9411564
Dec. 13, 1994 [GB] United Kingdom ..... 9425384

[51] Int. Cl.[7] ..... F04B 1/06

[52] U.S. Cl. ..... 417/219; 417/273; 91/498

[58] Field of Search ..... 91/498, 484, 488, 91/497; 417/219, 273, 460, 462; 418/26, 25, 30

[56] References Cited

U.S. PATENT DOCUMENTS

| | | | |
|---|---|---|---|
| 755,759 | 3/1904 | Franzen . | |
| 1,250,170 | 12/1917 | Hele-Shaw et al. . | |
| 1,656,544 | 1/1928 | Thoma . | |
| 2,646,754 | 7/1953 | Overbeke . | |
| 2,807,140 | 9/1957 | Tyler . | |
| 3,010,405 | 11/1961 | Tomell . | |
| 3,682,044 | 8/1972 | Ankeny et al. . | |
| 3,750,533 | 8/1973 | Thoma . | |
| 4,091,717 | 5/1978 | Bojas et al. . | |
| 5,239,827 | 8/1993 | Havens . | |
| 5,249,512 | 10/1993 | Christenson . | |
| 5,651,301 | 7/1997 | Thoma et al. | 417/219 |
| 5,848,565 | 12/1998 | Thoma | 417/219 |

FOREIGN PATENT DOCUMENTS

| | | |
|---|---|---|
| 2243138 | 3/1974 | Germany . |
| 524199 | 8/1940 | United Kingdom . |
| 730094 | 5/1955 | United Kingdom . |
| 1302084 | 1/1973 | United Kingdom . |

*Primary Examiner*—Charles G. Freay
*Attorney, Agent, or Firm*—Young & Thompson

[57] ABSTRACT

A hydraulic reciprocating piston machine having a housing, a rotatable cylinder-barrel having a series of cylinders and each cylinder containing a piston which is operatively connected to a reaction member. The reaction member being urged by the forces created from those pistons subject to the pressure phase of the working cycle toward and against an abutment-member. The reaction member is purposefully provided with a limited freedom for movement with the housing, and the action of the pistons forces in urging the reaction member towards the abutment-member provides for a substantial reduction in the normal vibration of the reaction member without binding between the adjacent bearing surfaces.

25 Claims, 7 Drawing Sheets

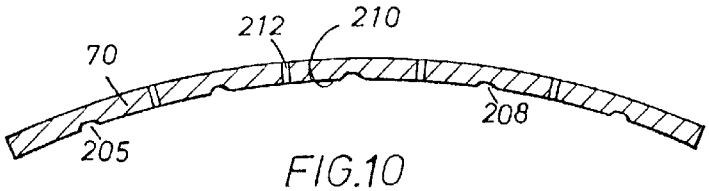
FIG.10
FIG.9
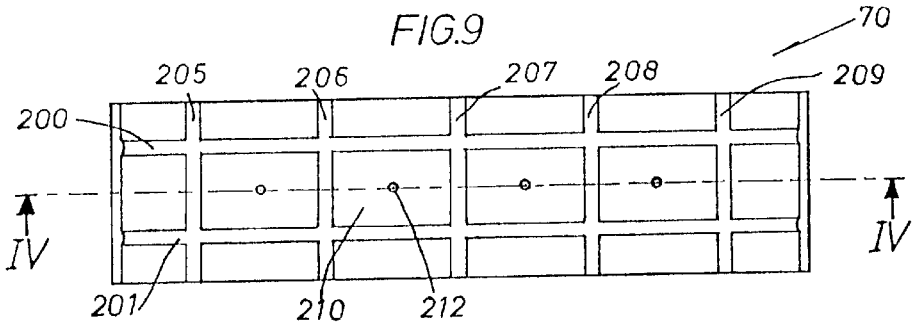
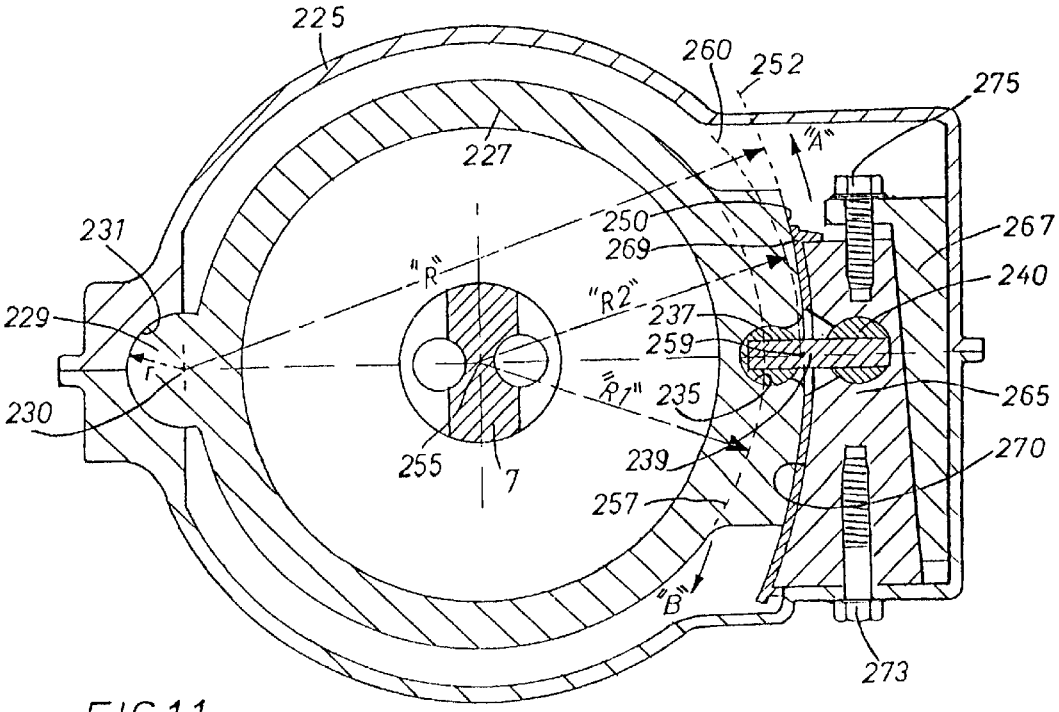
FIG.11

HYDRAULIC RADIAL PISTON MACHINES

FIELD OF THE INVENTION

This invention relates to positive displacement reciprocating piston machines of the type where the displacement of a piston within a cylinder causes fluid to be displaced within that cylinder.

For purposes of definition, a radial piston hydraulic machine of the high-speed variable-displacement kind can either be of the type where a rotary cylinder-barrel is mounted for rotation on a ported pintle-valve or where the cylinder-barrel is mounted for rotation on a shaft. In the second type, a stationary axial distributor-valve is fluidly connected to the cylinder-barrel to act as the means for porting the individual cylinders.

Radial piston machines have a number of advantages over other type of hydrostatic machines such as improved self-priming, particularly important in open-circuit pump systems, as the centrifugal effect tends to throw the pistons from their cylinders, especially when the cylinder-barrel is travelling at high rotational speed. Furthermore, the response time in changing the rate of fluid output is exceedingly fast, principally due to the use of low stroke/bore ratio's.

In the type of radial piston machine employing a pintle-valve, a cylinder-barrel mounted for rotation about its longitudinal axis, and where the cylinder-barrel is provided with a series of generally radial cylinder-bores. Each cylinder-bore contains a piston and each piston is operatively connected to the surrounding annular track-ring. The annular track-ring may be set into an eccentric positional relationship with respect to the rotating axis of the machine to determine the amount of piston stroke. The arcuate-slots in the pintle-valve are arranged to communicate with fluid inlet and outlet conduits attached to the exterior of the machine, and thus rotary movement of the cylinder-barrel is accompanied by radial displacement of the pistons and corresponding displacement of fluid through these conduits. The control-system of the machine operates in determining the required degree of eccentricity required between the track-ring and the pintle-valve for the piston stroke, so that the demands of a hydraulic system or circuit can be satisfied. The control-system thereby acts to regulate the supply of hydraulic fluid output from the hydrostatic machine to meet the varying fluid demands of the hydraulic system or circuit.

Variable-delivery radial piston machines have displaceable track-rings which can vary the stroke of the pistons on an imaginary line projecting generally parallel to the longitudinal axis of the arcuate-slots provided on the pintle-valve, or the banana-shaped slots in the case of an axial distributor-valve. All the piston reaction load acting on the track-ring have to be transmitted in some manner into the body of the housing. Based on geometric and kinematic considerations, prior art track-rings have been purposely constrained so that movement can only take place in accordance with one of the six possible degrees of freedom, this being achieved in either of following manners:

(i) In this type the track-ring is positioned in the housing so as to be able to be guided to slide in a straight-line fashion along a surface track or tracks. Typically two hydraulic-rams operate the track-ring to cause it to move along the surface track or tracks in order to change or adjust its eccentric position relative to the rotating axis of the machine. Examples of which are shown Great Britain Patent No. 1,302,084 and U.S. Pat. Nos. 1,656,544 and 2,807,140. Track-rings of this type are subjected to severe forces, from both the piston forces acting on the inner diameter as well as the hydraulic-ram forces acting on the outer diameter, these forces acting transversely to each other such that they cannot cancel each other out. Consequently, the track-ring must be of sufficient bulk and material strength to resist such adverse forces, in particular, those forces generated by the two opposing hydraulic-rams which in effect, act to trying to collapse the track-ring. The track-ring must be designed to resist deformation and consequently the material most often used is a heat-treatable alloy steel.

(ii) The track-ring of this type is journaled on a pivot-pin, the pivot-pin being in turn fixedly held in position in the housing structure of the machine. An example of which is shown in U.S. Pat. No. 3,750,533 where mechanical manually-operated displacement means may be used for pivotal movement of the track-ring, or alternately, by use one or more hydraulic-rams as shown in U.S. Pat. No. 3,010,405. For both manually-operated and hydraulically operated displacement means, the connection to the track-ring is most arranged near a point generally defined as being diametrically opposite the point of location for the pivot-pin. The section of the material surrounding the pivot-pin hole in the track-ring is subject to some of the highest mechanical stress concentrations in the whole machine design, and has been known to cause failure of such machines. This can occur during overload conditions as the track ring has to dissipate the total piston force to the housing through the relatively small sized pivot-pin.

It is therefore an object of the present invention to provide a machine with a track-ring having a self-aligning ability under load, and exhibiting lower stress concentrations in order to reduce the likelihood of failure when subjected to overload conditions. Accordingly, in the best mode, the track-ring of the present invention is based on geometric and kinematic considerations whereby it is purposely constrained that movement can take place according to two of the six possible degrees of freedom that it would otherwise have unsupported.

It is a further object of the invention to provide simple actuating means for controlling the amount of piston displacement in the machine, and without the weakening disadvantages of the earlier types.

It is certainly well known by those familiar with the art that reciprocating piston machines can be extremely noisy in operation, and sometimes the components of these machines vibrate quite violently.

One of the main causes of noise in radial piston hydraulic machines is the high-frequency vibration of the track-ring. During the period of one full revolution of the cylinder-barrel, at the instant when the fluid contained within one of the cylinders becomes pressurized, a force impulse is transmitted by the piston to the track-ring. As each successive cylinder becomes pressurized, each piston in turn transmits a further impulse to the track-ring. Collectively, these impulses cause the track-ring to shake and vibrate, the effect being greatly amplified because the vector resultant of all the pistons subjected to pressurized cylinders is continually changing in value and direction. Unless subdued in some manner, the vibration and noise of a machine is objectionable for environmental reasons, and can cause an unstable fluid output affecting the smooth operation of other machinery downstream in the hydraulic circuit.

Such described difficulties can become particularly acute in instances where the track-ring is supported on a pivot-pin and connected to a displacement control-shaft by a number of linkage pins. In prior machines, it has been found that undersireable vibration can be reduced by the use of hydraulic dampers which bear directly against one end face of the track-ring (Bojas U.S. Pat. No. 4,091,717) to bodily hold it against an interior surface in the housing, or else by the use of a pre-set mechanical restraining device (Havens U.S. Pat. No. 5,239,827). These prior solutions have the disadvantage that they act in clamping the track-ring to the housing which can inhibits free movement of the track-ring. Significantly, both prior solutions apply load to the track-ring transverse to the actual direction of piston movement, and are less effective because they merely try to neutralize the symptom of the problem, and not the cause.

It is therefore a further object of the invention to use the cyclic variation of the forces generated by the pistons to good effect and provide means for the pistons to urge the track-ring in a manner whereby the usual vibration of the track-ring is substantially reduced.

SUMMARY OF THE INVENTION

From one aspect of the invention consists of a radial piston machine comprising a housing, a rotatable cylinder-barrel disposed in the housing and supporting a series of radial pistons, an annular track-ring surrounding said cylinder-barrel such that the pistons bear on the track-ring, the track-ring being mounted for pivotal movement in a radial plane about an eccentric axis parallel to the axis of rotation of the cylinder-barrel, and abutment-surfaces comprising a concave first part-cylindrical bearing-surface on the interior of said housing, and a complementary convex second part-cylindrical bearing-surface on an exterior portion of said track-ring, said first and second bearing-surfaces describing cylinders having a common axis coincident with said eccentric axis.

In this invention, the pivotal movement of the track-ring in order to vary the reciprocating stroke of the pistons is the same as that for the pivot-pin arrangement, where the track-ring is fully journaled on the pivot-pin. However, in the present invention, the means provided on the eccentric axis for defining the pivotal motion of the track-ring no longer has to support the main loads generated by the pistons.

In the present invention, the main loads generated by the pistons are carried by abutment-surfaces at the periphery of the track-ring, the first bearing-surface of the abutment-surfaces is preferably provided on a radially extended exterior portion of the track-ring of part-cylindrical form generated by striking an arc from the eccentric axis. The second bearing-surface of the abutment-surfaces may be a separate abutment-member fixed to the housing or a surface machined directly into the interior of the housing. The first bearing-surface is urged towards the mating second bearing-surface by the pistons urging the track-ring in a generally radial direction away from the eccentric axis. Preferably the eccentric axis should lie radially outwards from the rotational axis of the cylinder-barrel, and may even lie outside the housing of the machine. The eccentric axis is preferably located to one side of the rotating axis of the cylinder-barrel and the abutment-surfaces located on the opposite side. Those pistons in the working cycle of the machine positioned at any one instant on the side nearest the eccentric axis are subjected to low-pressure fluid whereas those pistons on the side nearest the abutment-surface are subjected to high-pressure fluid.

Preferably the exterior portion defining the first bearing-surface is arranged to extend circumferentially beyond the fluctuation range of the resultant piston force vector, and preferably carries most of the piston load such that that material of track-ring adjacent to the second bearing surface is subjected to only compressive stresses. Furthermore, at least three other considerations should be taken into account, namely: the amount of first bearing-surface area to be available for contact with the second bearing-surface; the timing position of the arcuate-slots on the pintle-valve; and the number of cylinders used in the machine. Consequently, the track-ring of the present invention may be of lighter construction and lower material strength than earlier types. Furthermore, the track-ring of the present invention has a further advantage in applications where hydraulic-rams are used to control its eccentric position, as the forces generated by the hydraulic-rams are less likely to cause undue deformation in the shape of the track-ring.

The track-ring is able to pivot about the eccentric axis and move radially in a radial plane towards the abutment-surfaces, and where cyclic variation of the magnitude and direction of the piston forces is used to good effect in preventing the track-ring from binding or jamming in any one position against the abutment-member, here called the "anti-binding-system", analogous in certain respects to anti-locking braking system "ABS" used in modern-day motorized passenger-vehicles. The abutment-surfaces are hypostatically joined together with fluid dispersed between the interface providing a "squeeze-film" effect to promote longevity of the bearing-surfaces and further facilitating the damping of those forces trying to vibrate the track-ring. In certain applications, it may be an advantage to provide a pressurized hydrostatic fluid bearing on either one of these bearing-surfaces, although alternatively, a number of grooves may be provided to allow the access of fluid from the internal chamber of the machine.

However, the abutment-surfaces may be prevented from separating by the provision of hydraulic or mechanical biasing means on either side. For instance, a wedge-member may be used to preset the first and second bearing-surfaces in position. Similarly, spring means or a strut-member could be used to bias these first and second bearing-surfaces together. Alternatively, the machine may be assembled so that a small initial clearance can exist between the first and second bearing-surfaces, and this may be as much as 0.5 mm. However in each case, the first and second bearing-surfaces are self-compensating for wear during the service life of the machine, as they have the ability to automatically re-adjust themselves. This contrasts with prior art machines where the interconnecting parts have to be manufactured with great accuracy in order to ensure that they fit together and operate in the manner required, although inevitably, some clearance will always exist between the parts, allowing the track-ring to vibrate unless constrained in doing so.

Typically a pin may be provided to protrude axially from either side of the track-ring, or a part-cylindrical boss formed on the outer wall of the track-ring. Either they or intermediate bearing means are permitted to slide in a slot or slots formed in the interior of the housing. In the case of the boss, small radial movement in a direction away from its complementary cupped slot does not cause a ceasation in the engagement between these parts, as the boss can move slightly laterally in order to remain in contact with some portion of the cupped slot.

The bearing-surface of the abutment-member can be produced in a wide range of suitable materials, for instance, it may be made from a rigid material such as steel, cast-iron, powder-metal, with or without heat-treatment to promote surface hardness, or of a deformable material such as bronze or even synthetic plastic. In prototypes, an unhardened mild-steel component has been used and found to be satisfactory for the invention to perform as intended.

Although the embodiments of the invention described and illustrated are for the pintle-valve type of radial piston machine, the principles can also be applied with similar advantage to the axial distributor-valve type of radial piston machine. The invention is also applicable for both manually and mechanically controlled machines as well as machines having one or more hydraulic-rams to effect displacement of the track-ring. These and other objects of the invention will be apparent from reading the specification and referring to the embodiments illustrated.

BRIEF DESCRIPTION OF THE DRAWINGS

The invention may be performed in various ways and four specific embodiments over the conventional art are now described by way of example with reference to the accompanying drawings, in which:

FIG. 9 is a plane view of the surface of the abutment-member with incorporated fluid bearing.

FIG. 10 is a view of FIG. 9 at line IV—IV.

FIG. 11 is a sectional end view of the second embodiment of the invention with incorporated mechanical biasing means.

Figure 2:
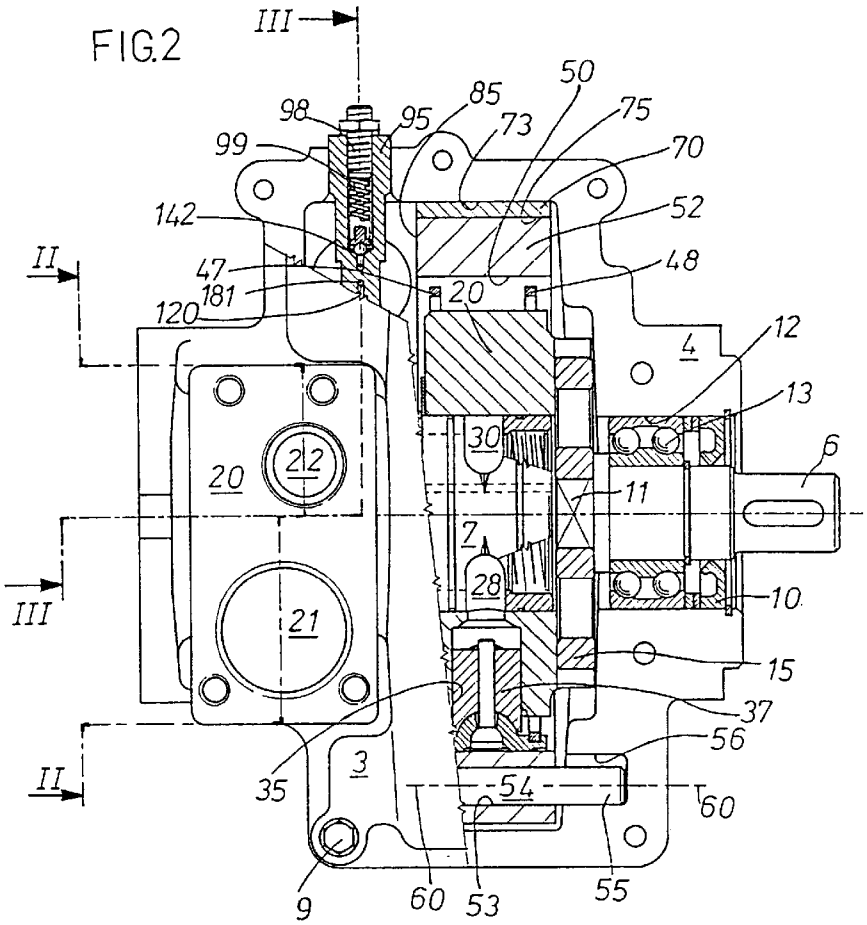
FIG. 2 is a sectional plane view of the machine of FIG. 1 on the line I—I.
Figure 1:
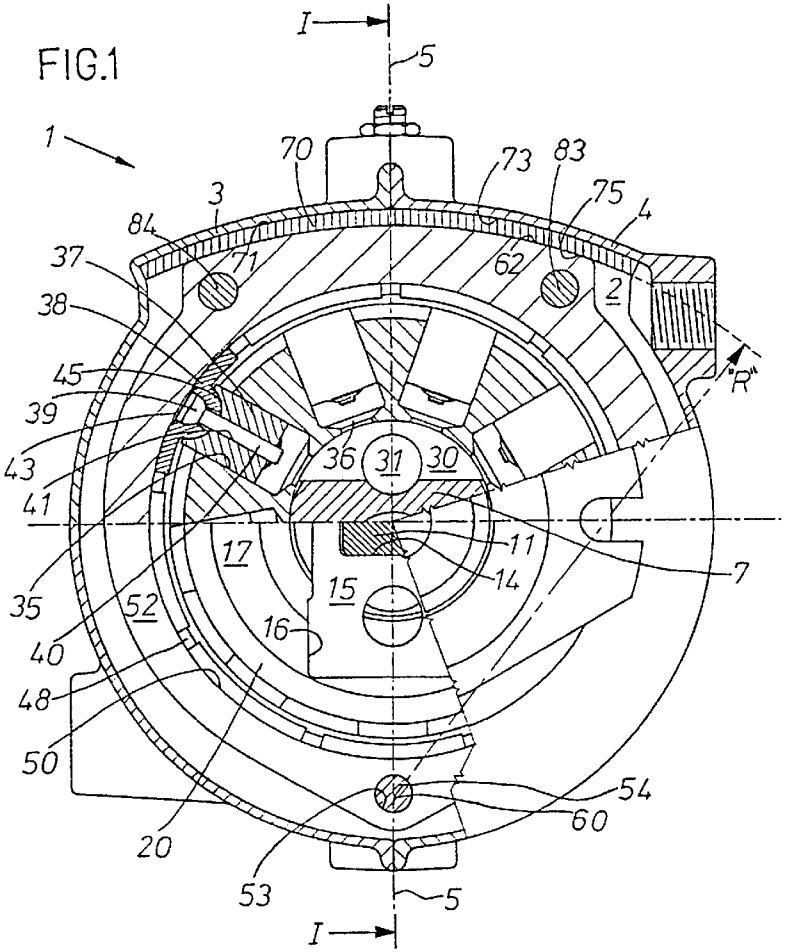
FIG. 1 is a sectional end view of the radial piston machine according to the invention.

In the first embodiment of the invention shown in FIGS. 1–4, the machine 1 comprises an outer housing structure which surrounds the inner working elements of the machine 1 that are located in the internal chamber 2. The housing structure is formed by two shells 3, 4 of part-cylindrical form which interconnect with each other on a common parting-plane 5 along which the axes of the drive-shaft 6 and pintle-valve 7 will lie. A number of self-threading screws 10 are used to attach the shells 3, 4 together with anaerobic sealant applied to the parting-plane 5 interface between the shells 3, 4 to ensure that the internal chamber 2 is sealed.

A shaft-seal 9 is positioned between shells 3, 4 to surround the drive-shaft 6 in order to prevent any fluid escaping from the internal-chamber 2. Also shells 3, 4 combine to form an internal cylindrical location pocket 12 for a bearing 13, such as ball-bearing which provides support for drive-shaft 6. A tongue 11 provided on drive-shaft 6 fits into a corresponding slot 14 provided in an "oldham" type misalignment coupling 15. The coupling 15 fits into a slot 16 provided on the end face 17 of the cylinder-barrel 20, and acts to compensate for any inaccuracy that may exists between the respective axes of the drive-shaft 6 and pintle-valve 7.

A flange-member 20 is provided which is attached by bolts 19 to shell 4, the flange-member 20 having a low-pressure admittance passageway 21 and a high-pressure delivery passageway 22. Passageway 21 connects through an opening 24 provided in shell 3 to a slot 25 provided in the pintle-valve 7 which intersects with longitudinal bore 27. Longitudinal bore 27 passes along the longitudinal axis of the pintle-valve 7 allowing fluid to reach the arcuate-slot 28. The opposite arcuate-slot 30 intersects with longitudinal bore 31 allowing fluid to exit the machine 1 by passing through the interior of the non-deformable liner-element 33 to the delivery passageway 22 in the flange-member 20. Both passageways 21, 22 can be threaded to accept suitable external fluid-conduit (such as a pipe) which thereby can connect the machine 1 to a hydraulic circuit.

The cylinder-barrel 20 is supported for rotation on the pintle-valve 7 and includes a number of cylinder-bores 35 each connected through a respective "necked" cylinder-port 36 to allow fluid distribution between each of the cylinder-bores 35 and a respective pair of elongate arcuate-ports 28, 30, formed on the periphery of the pintle-valve 7.

Each cylinder-bore 35 contains a piston 37 which is attached to a respective slipper 38 by means of a rivet 39. The longitudinal or shank portion 40 of the rivet 39 is a relatively close fit inside an axial longitudinal hole 41 provided in the piston 37, so allowing the required amount of pressurized fluid to bleed from cylinder-bore 35 to reach the bearing-face 43 of the slipper 38 for the creation of a hydrostatic bearing in a manner well known in the art. Pistons 37 and slippers 38 mate together on a part-spherical socket 45 to allow articulation of the slipper 38 on the piston 37. Guidance-rings 47, 48 are provided and serve to keep the slippers 38 in close proximity with the annular surface 50 of the track-ring 52. This feature combined with the centrifugal force on the piston/slipper serves to enhance the suction characteristics of this type of hydrostatic machine 1 when it is used as a self-priming pump.

In this embodiment, the track-ring 52 is provided with a hole 53 into which is fitted a location-pin 54, the location-pin 54 being extended to protrude from the hole 53 in order that both ends can engage with tracks provided on both sides of the housing of the machine 1, for instance, as shown with end 55 positioned in slot 56 of shell 4. A similar slot is provided in shell 3, both slots forming a track-surface on which location-pin 54 has freedom to float by sliding or rolling along one axis of movement, in a direction transverse to the rotational axis of the machine 1. The longitudinal axis of location-pin 54 is the eccentric axis 60 for the machine 1, location-pin 54 can move along slot 56 as required to compensate for dimensional imperfections in the associated components.

An abutment-member 70 is provided with a concave first part-cylindrical bearing-surface 75 defined by an arc struck from the eccentric axis 60 by radius "R". It is also provided with part-cylindrical outer surface 71 which is positioned for location in the housing to be adjacent internal wall 73 of shells 3, 4. Track-ring 52 is provided with a radially extended exterior portion which is the convex second part-cylindrical bearing-surface 62 which is also defined by an arc struck from the eccentric axis 60 by radius "R".

When pressurized fluid is present in arcuate-slot 30, the general direction of forces from the working pistons 37 of the machine 1 as they act through their respective slippers 38 against the annular surface 50 of the track-ring 52, causes the abutment-surfaces comprising concave first part-cylindrical bearing-surface 75 and convex second part-cylindrical bearing-surface 62 engagement-surface to be urged together. At the same instance, a small radial movement takes place as location-pin 54 travels along slot 56.

Figure 4:
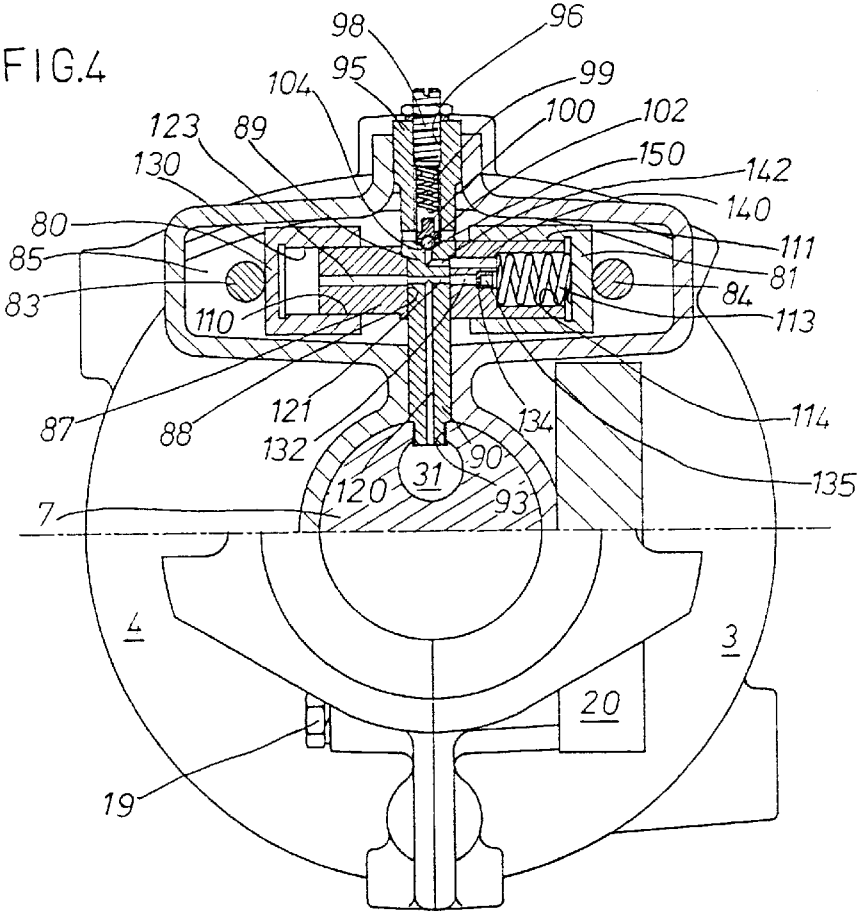
FIG. 4 is a part-sectional rear view of the machine of FIG. 2 on the line III—III.
Figure 3:
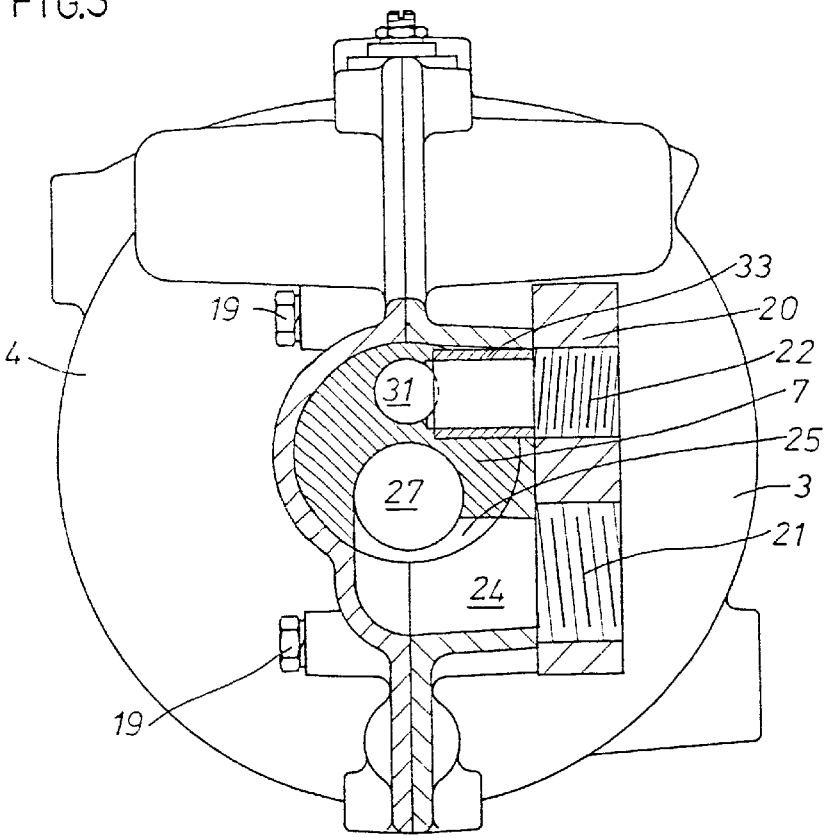
FIG. 3 is a part-sectional rear view of the machine of FIG. 2 on the line II—II.

In this movement, the track-ring 52 of the machine 1 is actuated by hydraulic-rams 80, 81. As shown in FIG. 4, two pins 83, 84 protrude from end face 85 of the track-ring 52 and where each pin 83, 84 is engaged by their respective actuating hydraulic-rams 80, 81.

The actuation support means essentially comprises two main components, a valve-body 87 which is provided with a hole 88 arranged transverse to its longitudinal axis, and a control-valve 89 which is inserted through hole 88 to be a tight and leak free fit. The control-valve 89 is threaded at one of its ends 90 to be screwed into hole 93 provided in the pintle-valve 7 that intersects with longitudinal passageway 31. The opposite end 95 of the control-valve 89 has an internal thread 96 into which an adjustment-screw 98 is located, the adjustment-screw 98 allowing the tension of the spring 99 to be changed. The spring 99 is guided on a shoe 100 to force the ball 102 against seat 104, the spring 99, ball 102 and seat 105 comprising the pressure relief-valve of the machine 1.

The valve-body 87 is cylindrical at both ends 110, 111, and where each respective hydraulic-ram 80, 81 slides over each respective end 110, 111. A spring 113 is disposed in chamber 114 at end 111 and acts to press the hydraulic-ram 81 against pin 84.

Passage 120 is provided in control-valve 89 which intersects with transverse passage 121 to connect with passage 123 provided in end 110 of valve-body 87 to the cylinder 130 of the small hydraulic-ram 80. Transverse passage 121 also connects with passage 132 provided in the end 111 of valve-body 89, the fluid passing through an orifice 134 of the throttle-valve 135 before entering the cylinder 138 of the large hydraulic-ram 81. A further passage 140 is provided in end 111 of valve-body 87 allowing the fluid within cylinder 138 to pass back into the control-valve 89 via passages 142 to reach the seat 104 adjacent the underside of the ball 102. When the pressurized fluid acting over the area of the seat 104 produces a force sufficient to lift the ball 102 off from the seat 104, the level of pressure of the fluid within cylinder 138 falls, and some of the fluid within the cylinder 138 escapes past the lifted ball 102 to be expelled by cross-passage 150 into the internal chamber 2 of the machine 1.

OPERATION OF THE MACHINE

The operation of the machine 1 is as follows: Rotation of the drive-shaft 6 causes the cylinder-barrel 20 to rotate. If track-ring 52 is set in an eccentric relationship to the pintle-valve 7, outward sliding movement of the pistons 37 in their respective cylinder-bores 35 is obtained, such that fluid from some external source, such as a hydraulic reservoir, is drawn in through the low-pressure fluid admittance passageway 21 and passes pintle-port 25, longitudinal bore 27, arcuate-port 28 to the interior of cylinder-bore 35 via "necked" cylinder-port 36. As the piston 37 returns inwards in its cylinder-bore 35, the fluid is expelled from the interior of cylinder-bore 35 via "necked" cylinder-port 36 into the opposite arcuate-port 30 from where it is directed along longitudinal bore 31 and through to the non-deformable liner-element 33 to reach the high-pressure fluid discharge passageway 22 from where it may be piped to service a hydraulic circuit, such as a hydraulic motor. During periods when the ball 102 remains loaded against its seat 104 by spring 99, the level of pressurized fluid in both cylinders 130, 138 remains the same. As hydraulic-ram 81 (downstream of the throttle-valve 135) is larger in area than hydraulic-ram 80, larger hydraulic-ram 81 produces a greater force on pin 84 than the smaller hydraulic-ram 80 on pin 83. The net effect is that the greater force on pin 84 holds the track-ring 52 in an eccentric relationship to the pintle-valve 7.

Once the level of pressurized fluid under the ball 102 at seat 104 has become sufficiently high to produce a force that compresses spring 99, the ball "lifts" off its seat 104 and the level of pressure in cylinder 138 reduces. However, as the level of pressure in cylinder 130 remain largely unaffected, as the amount of pressurized fluid passing through orifice 134 of throttle-valve 135 is very small, the net effect is that the force produced by the smaller hydraulic-ram 80 on pin 83 is now greater than the force produced by the larger hydraulic-ram 81 on pin 84. As a consequence, the eccentric position of the track-ring 52 is reduced in relation to the rotational axis of the machine 1.

Figure 5:
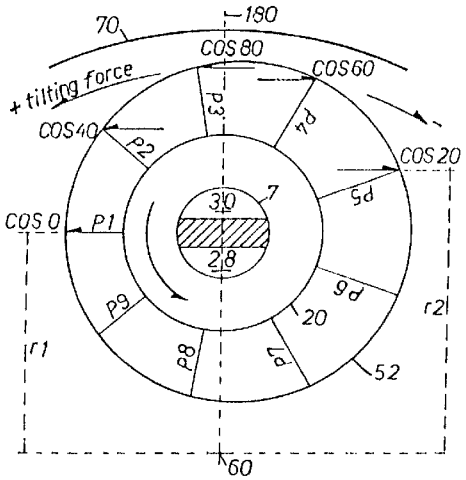
FIG. 5 is a diagram showing the relative position of the piston reactions against the track-ring for a 9-cylinder machine of the type shown in FIGS. 1–4.
Figure 6:
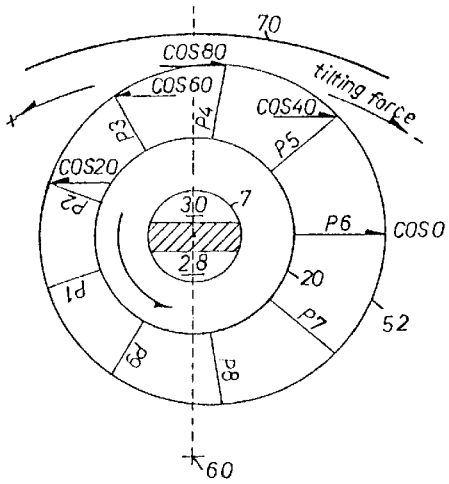
FIG. 6 is a diagram showing the relative position of the piston reactions after forty degrees of cylinder-barrel rotation.

FIGS. 5 & 6 are pictorial representations for a 9-cylinder machine of the type shown in FIGS. 1–4, and where the circles marked as 7, 20 and 52 represent the pintle-valve, cylinder-barrel and track-ring respectively. The abutment-surface is shown as 70 and the eccentric axis as 60.

As the cylinder-barrel 20 rotates in an anti-clockwise direction, each of the pistons 37 shown as P1 to P9 in turn are subject to high and low pressure during one full rotation of the cylinder-barrel 20, as their respective cylinders 35 communicate with arcuate-slots 30, 28, arcuate-slot 30 being at high pressure and arcuate-slot being at low or suction pressure.

As can be seen at the point in the working cycle shown as FIG. 5, pistons P1, P2, P3, P4, and P5 are under the influence of the high pressure in arcuate-slot 30. The high pressure produces a force on each of the pistons which acts generally along the longitudinal axis of the pistons, resulting in a corresponding sideways reaction force being directed on to the track-ring 52. The sideways reaction force is a function of the cosine value of their relative angular position about the pintle-valve 7. The vertical dotted line numbered 180 from the eccentric axis 60 which intersects the central axis of the pintle-valve 7 acts to divide these sideways reaction forces in a manner whereby those forces to the left side of the dotted line 180 produce as positive tilting force (and positive tilting moment as can be seen for piston P1 acting through arm shown as r1), whereas those force to the right side produce a negative tilting force (and negative tilting moment as can be seen for piston P5 which has an arm shown as r2).

The addition of all the reaction forces producing a positive tilting force are then subtracted from all the reaction forces producing a negative tilting force for this particular position of the pistons in the working cycle. The net effect is shown as the first point numbered 182 in the graph of FIG. 7 which shows the tilting force having the initial value of +0.5.

Figure 7:
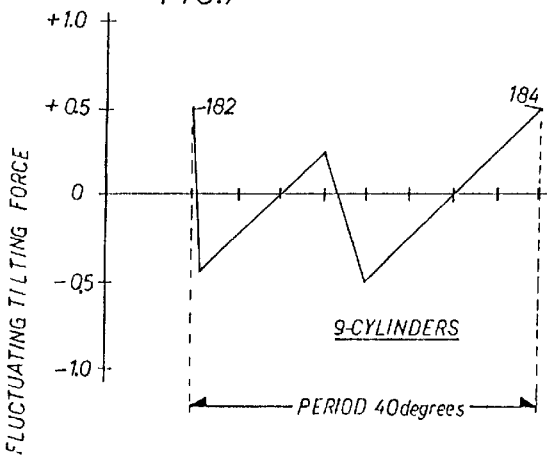
FIG. 7 is a graph showing the fluctuating tilting forces for the machine covering the period of forty degrees of cylinder-barrel rotation.

During the period of forty degrees of cylinder-barrel 20 rotation during which piston P1 comes out of the pressure phase to be replaced by piston P6 which comes under the influence of pressure, the net tilting force changes direction four times as shown by the shape of the graph in FIG. 7. At the end of the period, the position of the pistons are shown in FIG. 6, and where the tilting force has again the value of +0.5 as shown by the point numbered 184.

The force produced by a piston subjected to pressure is determined by multiplying the projected area of the piston by the pressure in the cylinder. Although the FIG. 7 portrays the fluctuating tilting force, it could also be converted to show the fluctuating tilting moment of the track-ring about the eccentric axis 60. To represent this information, the cosine of each piston force would be multiplied by the respective arm of the piston, for instance arm "r1" for P1 and the shape of the resulting graph produced would be substantially similar to that of FIG. 7, although the size of the negative values would in this instance be substantially larger than the positive values.

Figure 8:
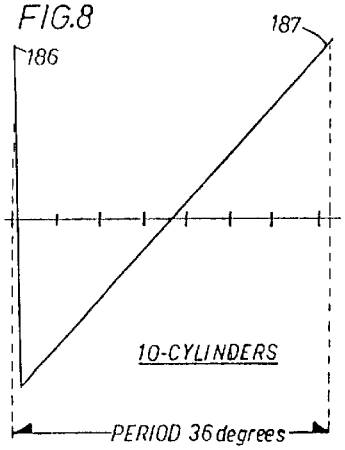
FIG. 8 is a graph showing the corresponding fluctuating tilting forces for a 10-cylinder machine covering the period of thirty-six degrees of cylinder-barrel rotation.

FIG. 8 is a graph produced to the same scale as FIG. 7 to show how the fluctuating tilting forces for a 10-cylinder machine compare to the 9-cylinder machine already described. Importantly, it can be seen that the initial and final value of the tilting forces numbered 186, 187 respectively are approximately double those generated by a 9-cylinder machine, namely +/−1. Furthermore, the number of reversals during the period are only two which is thought to significantly increase the likelihood of the track-ring 52 binding on the abutment-surfaces of the abutment-member 70. Therefore these diagrams FIGS. 5–8 show the significant advantage to be gained from the invention when an odd number of pistons is used.

In the modified abutment-member shown in FIGS. 9 & 10, fluid bearing means are provided on the first concave part-cylindrical bearing-surface although in practice, they could also be added on the second convex part-cylindrical bearing-surface on the track-ring.

As shown in FIG. 9, grooves 200, 201 are arranged to fully traverse the longitudinal length of the abutment-member 70 and whereby further grooves 205, 206, 207, 208, 209 are arranged at right-angles intersect with longitudinal grooves 200, 201 to form a grid pattern of islands, such as island 210 over the surface of the abutment-member 70. Fluid inside the internal chamber of machine can therefore pass along such grooves as 200, 201 and enhance the lubrication of the islands 210 that are urged by the working pistons of the machine towards the convex part-cylindrical bearing-surface on the track-ring 52. Fluid flowing through such grooves as 200, 201 to help minimize wear in the adjacent surfaces, and allows the release of any foreign matter that may have become lodged between the adjacent surfaces.

Near the center location of the islands 210, a hole 212 may be provided which can be serviced by pressurized fluid of the machine to create a hydrostatic bearing, the creating of w hich enhances the ability of the bearing-surface 62 to more readily slide over the bearing-surface 75 when the hydraulic-rams 80, 81 act to change the eccentric position of the track-ring 52 relative to the rotational axis of the machine.

For most applications, it will be important that the operational size of the hydrostatic bearings should be such that their collective force is either the same, or less than the collective piston forces urging the adjacent surfaces together. Similarly, if required, a further group of hydrostatic bearings could be disposed on the opposite and outer side of the abutment-member 70, these arranged to produce a collective force greater than those hydrostatic forces produced on the inner side of the abutment-member. As a result, a truly floating abutment-member is created to resist the fluctuating forces produced by the working piston of the machine.

The second embodiment of the invention shown as FIG. 11 has particular application when it is desirous that the abutment-surfaces should remain attached together during periods when the machine is at rest, or operating at low pressure. This can be useful when the machine is used as part of the infinitely variable speed hydrostatic transmission for a vehicle. As it is desirable that the displacement of the machine should remain set in any one position, a method for pre-loading the concave part-cylindrical bearing-surface to the convex part-cylindrical bearing-surface or vice versa has advantage in that it can perform even during periods when the pressurized fluid is too low to cause the track-ring to be urged to the abutment-member.

The cylinder-barrel containing the piston elements is omitted to ease understanding of this alternative embodiment. A housing 225 surrounds the hydrostatic machine, and where the annular track-ring 227 is provided with a semi-circular boss 229 which is of length preferrably equal to the width of the annular track-ring 227. Boss is located in cupped slot 231 provided in the housing 225. At the center of boss 229 lies the eccentric axis, the arc of the radius of the boss 229 from the center numbered 230 of the eccentric axis is shown as "r".

At the opposite side of the track-ring 227, a small longitudinal hole 235 in provided into which a shaft 237 is disposed. Shaft 237 is connected by link-pin 239 to the main displacement control-shaft 240 of the machine. The displacement control-shaft 240 is turned by the machine operator and this action causes shaft 237 to rotate such that the track-ring 225 pivots about the eccentric axis 230. This action causes the track-ring 227 to change from a concentric relationship with the pintle-valve 7 to an eccentric relationship, for instance, in the direction of arrow "A". Rotation of the displacement control-shaft 240 in the opposite direction by the machine operator causes the track-ring 227 to move in a direction shown by arrow "B".

The track-ring 227 is provided with an exterior convex part-cylindrical bearing-surface 250 which has its center of radius shown as "R" taking from eccentric axis 230. The arc produced is extended as shown by dotted-line numbered 252.

Usually the generally outer circular shape for the diameter of the track-ring is based on an arc of radius centered on the rotational axis of the machine, here shown as the point numbered 255. On the side of the rotational axis opposite to the eccentric axis 230, arc of radius "R1" as shown by dotted-line numbered 257 to complete the circle. In order to show the particular advantage of defining the arc of the abutment-surface from the eccentric axis 230, it is necessary to radially displace dotted-line 257 to a new position shown as dotted line 260. Dotted line 260 has a radius "R2" and is purposely shown intersecting point 259 lying on the abutment-surface 250. What is apparent is that the arc of radius "R" shown as dotted-line 252 for the abutment-surface 250 diverges from the arc of radius "R2" shown as dotted-line 260, as they both fan out from point 259.

Accordingly, the divergence between the arc's from point 259 allows the radial thickness of the track-ring 227 to be substantially increased, thereby increasing component strength and providing more space for the location of elements for the actuating means.

Abutment-member 265 is positioned by means of a wedge 267 and in this embodiment, a separate abutment-strip 269 is provided. The abutment-member 265 is provided with a complementary part-cylindrical surface 270, the abutment-member 265 being held to the housing 225 by means of a bolt 273. The wedge 267 acting on the abutment-member 265 is tightened in place by means of bolt 275 thus causing the abutment-member 265 and abutment-strip 269 to be loaded against the convex part-cylindrical bearing-surface 250 of track-ring 227. If the application for the machine requires that the track-ring 227 be exceedingly free for articulation purposes, bolt 275 forcing the wedge 267 against the abutment-member 265 is only lightly tightened. Further tightening of bolt 275 may be required if it is deemed necessary to obtain stiffness in the control-mechanism, for instance useful when the machine is used in applications where it is desirous that the track-ring remain set in one displacement position regardless of the operating pressure in the system.

Alternatively, a spring member could be used in place of the wedge 267, or a spring member could be disposed on the outside of the track-ring in the neighbourhood of the eccentric axis in order to bias the bearing-surface of the track-ring to the abutment-strip and create the same effect.

Although pre-loading the abutment-strip 269 against the bearing-surface 250 helps towards reducing vibration of the track-ring 227 when the machine is operating, the effect is greatly enhanced when the working pistons causes the bearing-surface 250 to be urged in the direction of the abutment-strip 269.

Figure 12:
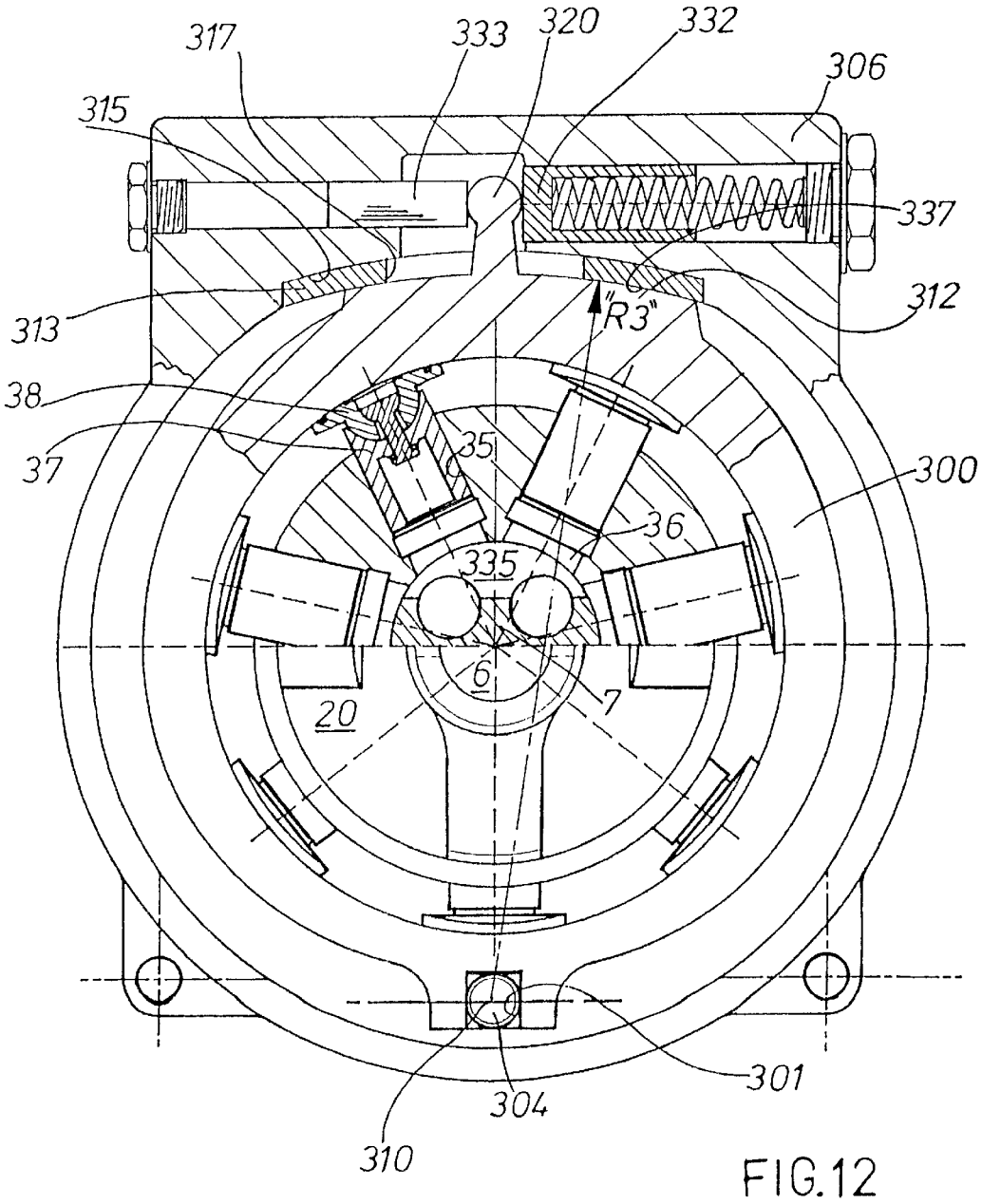
FIG. 12 is a sectional end view of the third embodiment of the invention.

In the third embodiment of the invention shown as FIG. 12, only those features that distinguish from the earlier embodiment will be described. Essentially, the track-ring 300 is provided with an open-ended slot 301, the longitudinal axis of the slot 301 is arranged to be transverse to the rotational axis of the machine. A pin 204 fixed to the housing 306 provides the fulcrum for the track-ring 300 as the pin 304 is guided by the surfaces of the slot 301. Radial movement of the track-ring 300 results in the radial movement of the slot 301 relative to the pin 304.

A radius "R3" taken from the eccentric axis numbered 310 lying on the longitudinal axis of pin 304 defines the convex part-cylindrical shape of the bearing-surface 312 covering a portion of the total circumferential length of the track-ring 300.

Abutment-member 313 is placed in a recess 315 provided in housing 306 to be restrained from movement by the recess 315. The abutment-member 313 has a central aperture 317, and where a radial projection 320 formed on the track-ring 300 is arranged to protrude through aperture 317 to be operatively engaged by hydraulic-rams 332, 333.

Pressurized fluid in arcuate-slot 335 and cylinders 35 causes the pistons to urge the bearing-surface 312 of the track-ring 300 towards the bearing-surface 337 provided on the abutment-member 313, with corresponding movement of the slot 310 over pin 304.

Although not shown, the ends of the hydraulic-rams may be fitted with shoes, and where the shoes are arranged for articulation about the longitudinal axis of the hydraulic-rams to compensate for angular misalignment caused with the track-ring is eccentric to the rotational axis of the cylinder-barrel. The shoes may have hydrostatic bearings if deemed necessary.

Figure 13:
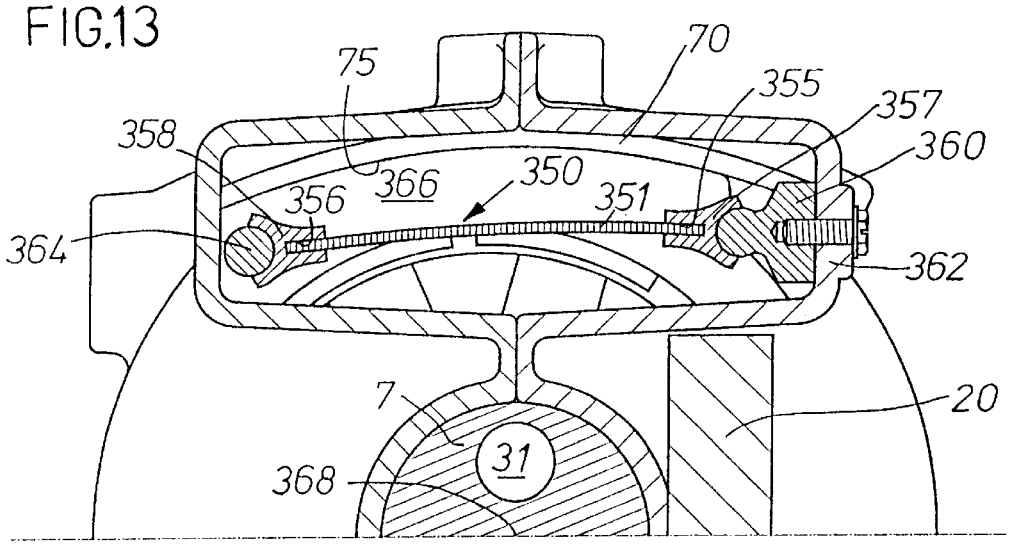
FIG. 13 is a sectional view of the fourth embodiment of the invention of a machine type shown as FIGS. 1–4 where a strut-member is used in place of hydraulic-rams. The strut-member being shown in a partially deformed condition corresponding to maximum eccentricity of the track-ring.
Figure 14:
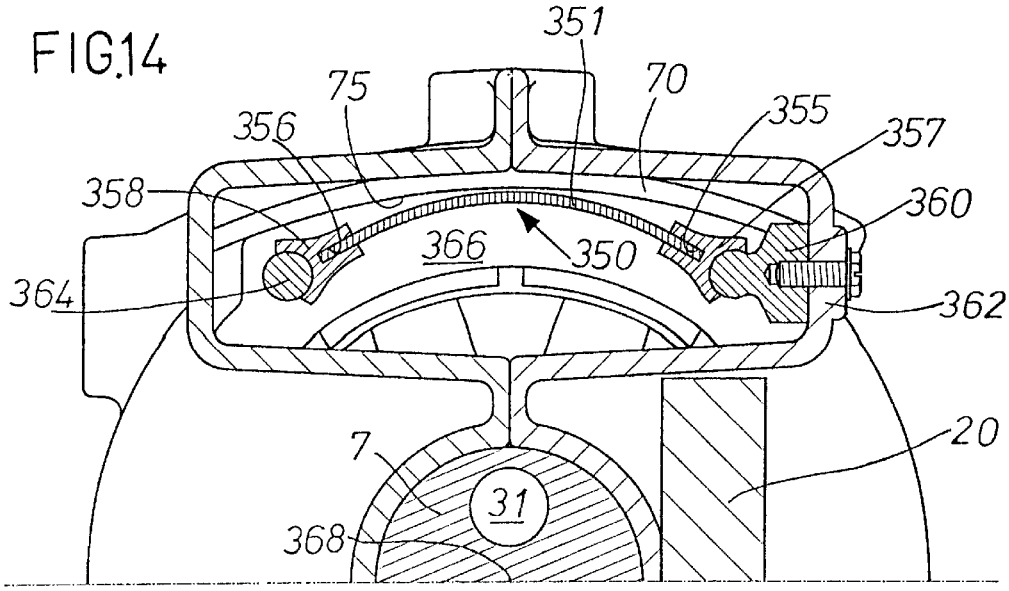
FIG. 14 shows the strut-member of FIG. 13 is its fully deformed condition corresponding to minimum eccentricity of the track-ring.

In the fourth embodiment of the invention shown as FIGS. 13 & 14, mechanical adjustment means are used in place of the hydraulic-rams and actuation support means of the first embodiment. The mechanical adjustment means as illustrated in this embodiment has particular advantage from a constructional point of view, it will be understood that significant advantage can still be obtained for a machine where either, the track-ring is journaled for pivotal movement on a pin fixed to the housing, or a machine employing axial pistons that bear on a swash-plate. The mechanical adjustment means 350 comprises a strut-member 351 having one or more laminations, and being held at each end in grooves 355, 356 provided in respective shoes 357, 358. Shoe 357 is engaged to a spherically headed plug 360 fixed to the housing 362 whereas shoe 358 to a pin 364 protruding from the end face of the track-ring 366. The strut-member 351 is disposed in the housing 362 to a have a partially deformed condition as shown in FIG. 13. In this initial position, the track-ring 366 is thereby held in an eccentric position relative to the rotational axis of the machine shown as point 368. During operation of the machine, when the forces created by the pistons under pressure reach a level sufficient to cause further deformation of the strut-member 351, the eccentricity of the track-ring 366 is reduced. When the strut-member 351 has reached its fully deformed condition as shown in FIG. 14, the track-ring 366 is approximately concentric with the rotational axis of the machine shown as point 368. Once the pressure level in the machine falls, and forces produced by the pistons on the track-ring 366 are insufficient to keep the strut-member 351 fully deformed, and the strut-member 351 reverts back to its initial partially deformed condition and the track-ring 366 moves back towards full eccentricity as shown in FIG. 13. The strut-member 351 is purposely located to be as close as possible to the abutment-surfaces 75 and furthest away from the eccentric-axis 60 of the machine, thereby increasing the mechanical advantage of leverage about the eccentric axis 60. As the abutment-member 70 substantially reduces the amount of track-ring 366 vibration during machine operation, the strut-member 351 behaves in a stable manner and in combination with the abutment-member 70, provides an exceedingly simple and cost-effective solution for a variable-flow machine. Such a strut-member can be used with good effect for the type of track-ring journaled on a pivot-pin, and also in the axial piston swash-plate type of hydrostatic machine, the strut-member in this case being biasing the swash-plate to a maximum angle with respect to the surrounding housing.

Figure 15:
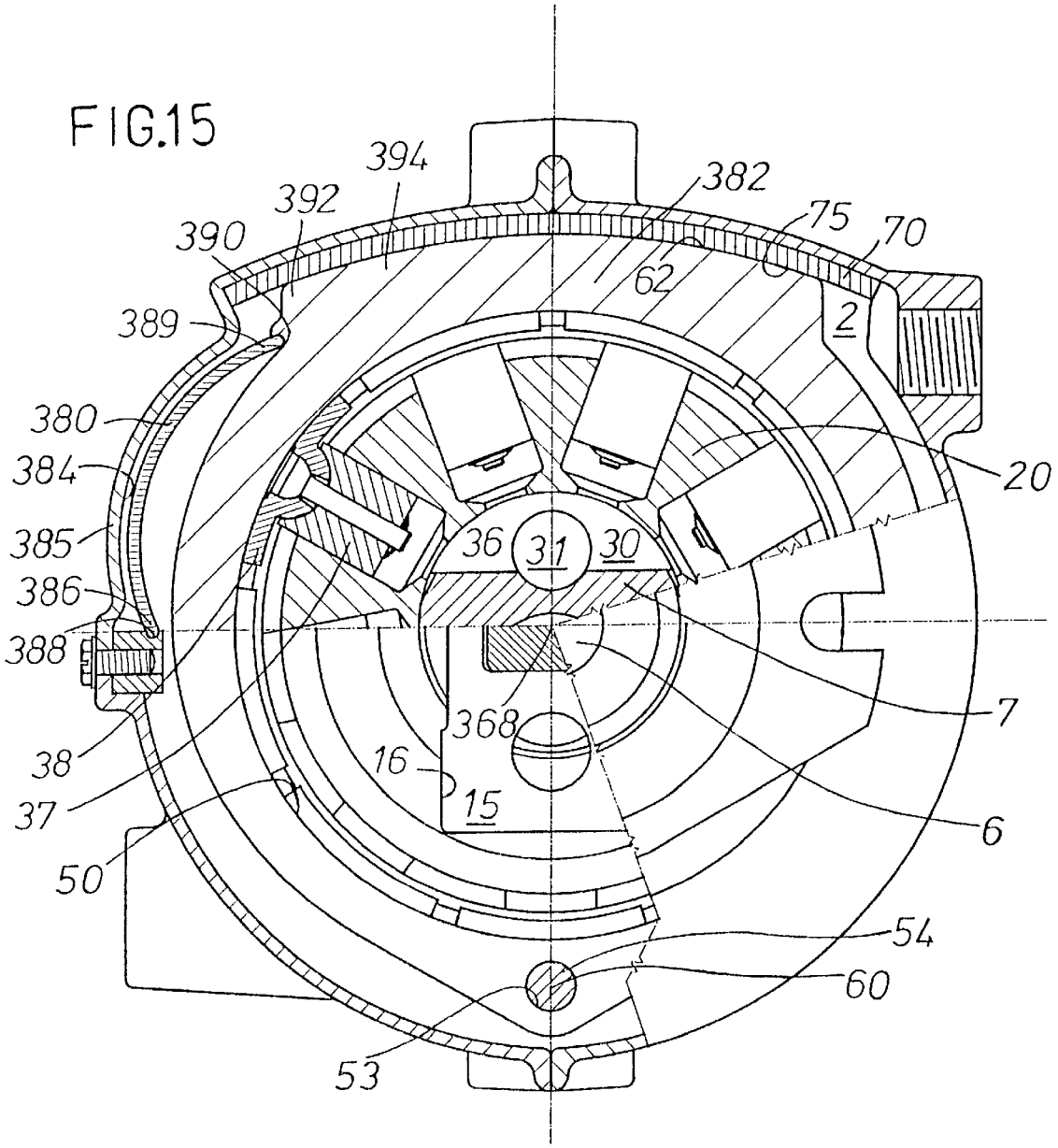
FIG. 15 is a sectional view of the fifth embodiment of the invention showing an alternative location for the strut-member.

In the fifth embodiment of the invention shown as FIG. 15, the strut-member 380 is positioned to one side of the track-ring 382 adjacent to a peripheral wall 384 of the housing 385. One end 386 of strut-member 380 is anchored at 388 to the peripheral wall 384 of the housing 385, and the other end 389 is anchored in a groove 390 provided at the end 392 of the radially exterior portion 394 of the track-ring 382. In this illustration, strut-member 380 is shown in its maximum deformed condition which corresponds to the track-ring 382 being is an approximately concentric relationship with the rotational axis of the machine shown as point 368. The strut-member 380 performs in the same manner as has been described for the fourth embodiment such that, when the pressure level in the machine falls, and forces produced by the pistons on the track-ring 382 are insufficient to keep the strut-member 380 fully deformed, and the strut-member 380 reverts back to its initial partially deformed condition and pivotal movement of the track-ring 382 occurs about the eccentric axis 60 and the track-ring 381 moves back towards full eccentricity.

Although the invention shown in the drawings has particular advantage from a constructional point of view, it will be understood that without the abutment-surfaces being particularly related to the eccentric axis, significant advantages can still be obtained.

We claim:

1. A radial piston machine comprising a housing, a rotatable cylinder-barrel disposed in said housing and provided with a series of cylinders each containing a piston, an annular track-ring surrounding said cylinder-barrel such that the pistons in said cylinders bear on said track-ring, said track-ring being mounted for pivotal movement in a radial plane about an eccentric axis parallel to the axis of rotation of said cylinder-barrel, and abutment-surfaces for controlling contact between said annular track-ring and the interior of said housing, said abutment-surfaces comprising a concave first part-cylindrical bearing-surface on the interior of said housing, and a complementary convex second part-cylindrical bearing-surface on an exterior portion of said track-ring, said first and second bearing-surfaces describing cylinders having a common axis coincident with said eccentric axis.

2. A radial piston machine according to claim 1 wherein said abutment-surfaces are arranged to resist the reaction force of said pistons in urging said track-ring in a direction towards said abutment-surfaces, and where said track-ring has a degree of radial freedom to move relative to the radial position of said cylinder-barrel.

3. A radial piston machine according to claim 2 and including a pintle-valve or equivalent fluid distribution means having a pair of arcuate-slots for fluid coupling with said cylinders of said cylinder-barrel, said pair of arcuate-slots comprising a low-pressure arcuate-slot and a high-pressure arcuate-slot and where said high-pressure arcuate-slot is the slot positioned nearest to said abutment-surfaces.

4. A radial piston machine according to claim 3 and including track-ring actuating means operatively connected to said track-ring and positioned adjacent to said abutment-surfaces.

5. A radial piston machine according to claim 4 wherein the said track-ring actuating means comprises at least one hydraulic-ram.

6. A radial piston machine according to claim 4 wherein said track-ring actuating means comprises a strut-member and where said track-ring is held in an eccentric position relative to said housing by said strut-member when said strut-member is in a partially deformed condition, and where rising pressure in said cylinders causes an increase in the deformation of said strut-member and a corresponding decrease in the eccentricity of said track-ring.

7. A radial piston machine according to claim 4 wherein said housing comprises two shells connectable together along a parting-plane coincident with the said rotating axis of said cylinder-barrel, and where said abutment-surfaces are disposed to both sides of said parting-plane.

8. A radial piston machine according to claim 1 wherein said eccentric axis has a limited ability to float in a direction transverse to the rotational axis of said machine to allow progressive engagement of said abutment-surfaces as the pressure level in said machine rises.

9. A radial piston machine according to claim 1 wherein a slot formed in the interior of said housing and adjacent to said eccentric axis acts to provide a guidance surface for the radial movement of said track-ring.

10. A radial piston machine according to claim 1 wherein a slot formed in the periphery of said track-ring and adjacent to said eccentric axis acts to provide a guidance surface for the radial movement of said track-ring.

11. A radial piston machine according to claim 1 including means for urging said track-ring and said abutment-surfaces together and resisting the reaction force of said pistons on said track-ring.

12. A radial piston machine according to claim 11 wherein those said pistons which at any instant are subjected to the pressure phase in the working cycle are acting on said track-ring to form the said urging means.

13. A radial piston machine according to claim 12 wherein the said urging means comprise resilient means or fluid means acting between said track-ring and said housing.

14. A radial piston machine according to claim 1 wherein said eccentric axis is disposed to one side of said rotation axis of said machine and the said abutment-surfaces are disposed on the opposite side.

15. A radial piston machine according to claim 1 wherein fluid lubrication grooves or hydrostatic bearings are provided on said abutment-surfaces.

16. A radial piston machine according to claim 1 wherein the said exterior portion covers at most 30% of the total circumferential length of said track-ring and has a surface area of at least two times greater than the surface area of one of the said pistons.

17. A radial piston machine according to claim 1 wherein mechanical biasing means are provided for pre-loading said abutment-surfaces together.

18. A radial piston machine according to claim 17 wherein said mechanical biasing means comprise a wedge-member or a strut-member.

19. A radial piston machine according to claim 1 wherein said abutment-surfaces are arranged to resist the reaction force of said pistons in urging said track-ring in a direction towards said abutment-surfaces, said track-ring having first and second degrees of freedom for motion relative to said cylinder-barrel, pivotal movement for the first freedom of motion, transverse movement to the said axis of rotating of said cylinder-barrel for the second freedom of motion.

20. A radial piston machine according to claim 1 wherein an arc "R" for defining the said exterior portion of said track-ring diverges from that arc "R2" defining a circle about the said axis of rotation of said machine.

21. A radial piston machine including a housing, a rotatable cylinder-barrel disposed in said housing and provided with a series of cylinders each containing a piston, an annular track-ring surrounding said cylinder-barrel such that the pistons in said cylinders can bear on said track-ring and abutment means disposed radially adjacent said track-ring, pivoting means for mounting said track-ring for allowing its radial position to be varied relative to the radial position of said cylinder-barrel for variation in the fluid displacement of said pistons and where said track-ring is further provided with a limited ability to float relative to said pivoting means towards said abutment means, and where said abutment means act to resist the reaction force of said pistons on said track-ring.

22. A radial piston machine as claimed in claim 21 and including a pintle-valve or equivalent fluid distribution means having a pair of arcuate-slots for fluid coupling with said cylinders of said cylinder-barrel, said pair of arcuate-slots comprising a low-pressure arcuate-slot and a high-pressure arcuate-slot and where said high-pressure arcuate-slot is the slot positioned nearest to said abutment means.

23. A radial piston machine including a housing, a rotatable cylinder-barrel disposed in said housing and provided with a series of cylinders each containing a piston, an annular track-ring surrounding said cylinder-barrel such that the pistons in said cylinders can bear on said track-ring and abutment means disposed radially adjacent said track-ring, said track-ring journalled on a pin supported in said housing and pivotable about said pin for allowing its radial position to be varied relative to the radial position of said cylinder-barrel for variation in the fluid displacement of said pistons and where said track-ring is provided with a limited ability to float towards said abutment means for resisting the reaction force of said pistons on said track-ring, a pintle-valve or equivalent fluid distribution means including a pair of arcuate-slots for fluid coupling with said cylinders of said cylinder-barrel, said pair of arcuate-slots comprising a low-pressure arcuate-slot and a high-pressure arcuate-slot, a deformable strut-member having a first end and a second end, said first end operatively connected to said housing and said second end operatively connected to said track-ring in a position nearest to said high-pressure arcuate-slot, and wherein said track-ring is held in an eccentric position relative to said housing by said strut-member when said strut-member is in a partially deformed condition, and where rising pressure inside said cylinders causes an increase in the deformation of said strut-member and a corresponding decrease in the eccentricity of said track-ring, said track-ring being in operational engagement with said abutment means as said strut-member deforms.

24. A reciprocating piston machine including a housing, a rotatable cylinder-barrel disposed in said housing and provided with a series of cylinders each containing a piston, the pistons in said cylinders being operatively connected to a surrounding piston reaction member, and where said piston reaction member is positioned inwardly adjacent to an abutment-member and where said piston reaction member is provided with freedom to float in the direction of said abutment-member, said abutment-member being arranged to resist the action of those said pistons subjected to the pressure phase in the working cycle in urging said piston reaction member in a direction towards said abutment-member, a pintle-valve or equivalent fluid distribution means including a pair of arcuate-slots for fluid coupling with said cylinders of said cylinder-barrel, said pair of arcuate-slots comprising a low-pressure arcuate-slot and a high-pressure arcuate-slot, a deformable strut-member having a first end and a second end, said first end operatively connected to said housing and said second end operatively connected to said piston reaction member in a position nearest to said high-pressure arcuate-slot, and wherein said piston reaction member is held in an eccentric position relative to said housing by said strut-member when said strut-member is in a partially deformed condition to cause maximum reciprocation of said pistons, and where rising pressure inside said cylinders causes an increase in the deformation of said strut-member and a corresponding decrease in the amount of reciprocation of said pistons, said piston reaction member being in operational engagement with said abutment-member as said strut-member deforms.

25. A reciprocating piston machine including a housing, a rotatable cylinder-barrel disposed in said housing and provided with a series of cylinders each containing a piston, the pistons in said cylinders being operatively connected to a surrounding piston reaction member and an abutment-member disposed radially adjacent said piston reaction member, said piston reaction member being journalled on a pin supported in said housing and pivotable about said pin for allowing its radial position to be varied relative to the radial position of said cylinder-barrel for variation of the reciprocating stroke of said pistons and where said piston reaction member is provided with a limited ability to float towards said abutment-member for resisting the reaction force of said pistons on said piston reaction member, a pintle-valve or equivalent fluid distribution means including a pair of arcuate-slots for fluid coupling with said cylinders of said cylinder-barrel, said pair of arcuate-slots comprising a low-pressure arcuate-slot and a high-pressure arcuate-slot, a deformable strut-member having a first end and a second end, said first end operatively connected to said housing and said second end operatively connected to said piston reaction member in a position nearest to said high-pressure arcuate-slot, and wherein said piston reaction member is held in an eccentric position relative to said housing by said strut-member when said strut-member is in a partially deformed condition to cause maximum reciprocation of said pistons, and where rising pressure inside said cylinders causes an increase in the deformation of said strut-member and a corresponding decrease in the amount of reciprocation of said pistons, said piston reaction member being in operational engagement with said abutment-member as said strut-member deforms.

* * * * *